US006648241B1

(12) United States Patent
Doshay

(10) Patent No.: US 6,648,241 B1
(45) Date of Patent: Nov. 18, 2003

(54) LIFE EXTENDING, POP-UP SPRINKLER INSERT

(76) Inventor: Irving Doshay, 380 Surfview Dr., Pacific Palisades, CA (US) 90272

( * ) Notice: Subject to any disclaimer, the term of this patent is extended or adjusted under 35 U.S.C. 154(b) by 24 days.

(21) Appl. No.: 10/028,087

(22) Filed: Dec. 21, 2001

Related U.S. Application Data

(63) Continuation of application No. 09/513,988, filed on Mar. 5, 2000.
(60) Provisional application No. 60/123,338, filed on Mar. 8, 1999.

(51) Int. Cl.[7] ..... B05B 15/10; B05B 3/00
(52) U.S. Cl. ..... 239/203; 239/201; 239/204; 239/206
(58) Field of Search ..... 239/201, 203, 239/204, 205, 206, 207, 281, 280, 280.5, 390, 392, 393, 394, 436, 537, 538, 581.1

(56) References Cited

U.S. PATENT DOCUMENTS 4,579,285 A * 4/1986 Hunter ..... 239/457
5,556,036 A * 9/1996 Chase ..... 239/457
5,630,549 A * 5/1997 Le ..... 239/451
6,019,295 A * 2/2000 McKenzie ..... 239/451
6,357,668 B1 * 3/2002 Doshay ..... 239/1

* cited by examiner

*Primary Examiner*—Davis Hwu
(74) *Attorney, Agent, or Firm*—Norton R. Townsley; Belasco Jacobs & Townsley, LLP

(57) ABSTRACT

A life extending, pop-up sprinkler comprising a riser pipe, a collar, a pop-up shaft with a threaded head, an O-ring, a weight, and a spray insert. The riser pipe is threaded at both ends. The lower threads are designed to mate with the specially threaded cavity in the sprinkler head body. Threaded onto the upper threads is the collar, which has a opening, having a hexagonal (or other shaped) cross-section, in its upper web. Sliding inside this opening is the cylindrical pop-up shaft which has a mating, outer, hexagonal (or other matching shaped) cross-section. The O-ring is slipped over the lower end of the shaft and a cylindrical (or other shaped) weight is screwed onto the lower end of the shaft. Both the O-ring and the weight are of larger diameters than the shaft so as to preclude leakage. The upper end of the shaft terminates in a cylindrical pop-up head which is also larger in diameter than the shaft. The upper end of the head is threaded to receive the spray insert, which is preferably identical to a standard spray insert. In typical fashion the insert has a small, upwards slanting exit hole or slot. In an alternate embodiment, an adapter to replace a sprinkler head is provided by utilizing the collar, the pop-up shaft with threaded head, the O-ring, the weight, and the spray insert described above. The collar is screwed directly onto the in-ground riser. The pop-up is assembled through the hole in the collar and the spray insert screwed into the pop-up head before the collar is screwed onto the in-ground riser.

8 Claims, 11 Drawing Sheets

LIFE EXTENDING, POP-UP SPRINKLER INSERT

REFERENCE

This invention was disclosed to the U.S. Patent and Trademark Office in Disclosure Document No. 386,410 received Sep. 11, 1995. The Applicant claims the benefit of his Provisional Application, serial No. 60/123,338, filed Mar. 8, 1999. This, Application is a Continuation of U.S. patent application Ser. No. 09/513,988 filed Mar. 5, 2000.

BACKGROUND OF THE INVENTION

The present invention relates to the field of lawn and garden sprinklers and particularly to pop-up, spraying inserts for such sprinklers.

Lawn and garden sprinklers have been available for many decades. Sprinklers are usually attached to a buried pipe system which is attached to a pressurized water supply via a valve. Pipe systems are usually constructed of galvanized steel pipe and fittings in a manner well known by plumbers. The valves may be manually or timer operated. When it is desired to water the grass, or plants or both, the valve is turned on. Many homeowners in the United States and other countries rely on such sprinklers to deliver water to their lawns and gardens during dry weather.

A typical sprinkler head is one manufactured by Champion, Los Angeles. The early, standard metal heads comprise a hollow, cylindrical, aluminum or galvanized steel body threaded at its lower entrance in order to screw onto the threaded riser. Usually, pipe threads are utilized in order to create a water-tight joint. At the upper end, a brass spray insert is screwed into a specially threaded cavity. The threads on the spray insert and the cavity are specifically not pipe threads to prevent improper assembly. The insert has an angled hole or slot that is designed to spray water upwards in an angle in an arc or a full circle. Inserts are available which will spray anywhere from approximately 30° to 360°. Inserts are also available with threaded restrictor screws so that the radius of the arc or circle may be adjusted. In other words larger or smaller arcs or circles can be sprinkles.

It is current practice to assemble sprinkler systems completely from plastic or with plastic horizontal segments and fittings, and plastic risers. However, decades ago, plastic pipe was not available so galvanized steel risers were used. In the intervening years, the galvanized piping system tends to corrode and the sprinkler head bodies corrode onto the risers. Moreover, with time the grade of the grass increases. Consequently, over time, spray from the sprinklers does not reach up over the adjacent grass and it is impossible to remove and replace risers or sprinkler heads or both without destroying the piping system. To rebuild a sprinkler system, by digging up and replacing the originally installed system, is very labor intensive and very expensive. To lower the grade of the grass is also very labor intensive and expensive.

Development of a modification which will allow sprinklers to operate properly again without the need to replace the sprinkler system or lower the grade of the grass represents a great improvement in the field of lawn and garden sprinklers and satisfies a long felt need of homeowners who have older, metal sprinkler heads installed.

There is another problem with currently available pop-up sprinkler heads. Pop-up sprinklers carry the spray head at the top of a weighted shaft which slides inside a hexagonal opening in the center of the sprinkler head body. When the water is off, the gravity is supposed to keep the pop-up down. Water pressure overcomes the weight and lifts the spray head for operation. However, the tolerances of the opening and shaft are very loose and garden debris accumulates in the bowl created by the sprinkler head body. As a result the pop-up frequently sticks in the up position where it may cause persons to trip or be cut off by a lawn mower. Once the pop-up is cut, the weight falls into the riser, from which it is difficult to retrieve, and a geyser is caused when next the sprinkler system is operated.

Development of a sprinkler modification which eliminates the bowl, thus eliminating accumulation of debris and eliminating sticking pop-ups also represents a great improvement in the field of lawn and garden sprinklers and satisfies a long felt need of homeowners.

There are a number of patents relating to sprinkler heads. U.S. Pat. No. 3,776,463 to Dyk discloses a complete sprinkler assembly 60 of singular design which includes an in-ground riser 20. The in-ground riser 20 attaches via a special inner component 51 and T-connector 50 to a horizontal pipe 70. The in-ground riser 20 is outwardly tapered 21 at the bottom for attachment to the outer saddle 52 by a lower hose clamp 30 and inwardly tapered 22 at the top. In other words, this is a compression attachment and not a threaded attachment. Attachment pressure is provided by combination of the taper 21 and the hose clamp 30. The in-ground riser 20 is clearly not a standard pipe with pipe threads.

The sleeve 61 contains the pop-up subassembly 62, 63, slides down inside the riser 20, and is secured in place by another hose clamp 40. The in-ground riser 20 is inwardly tapered 22 at the top. Again this is a compression not threaded attachment. Attachment pressure is provided by combination of the taper 22 and the hose clamp 40. And, as a consequence, the pop-up assembly 62,63 slides inside the sleeve 61 and not the riser 20.

U.S. Pat. No. 1,938,511 to Brady discloses a complete pop-up sprinkle? comprising: a riser tube 1, a collar 3; a pop-up subassembly 4; and a spray insert 12. The Brady invention is intended to mate with an externally threaded in-ground riser.

Both of these inventions are simply sprinkler systems. Neither of these inventions, either alone or in combination, will solve the problems that the instant invention is intended to solve.

SUMMARY OF THE INVENTION

The primary objective of the present invention is to modify sprinklers so that they will again operate properly without the need to replace the sprinkler system or lower the grade of the grass. This invention comprises a riser tube, a collar, a pop-up shaft with a threaded head, an O-ring, a weight, and a spray insert. The riser pipe is threaded at both ends. The lower threads are designed to mate with the specially threaded cavity (which is specifically not pipe threaded) in the sprinkler head body. Threaded onto the upper threads is the collar, which has a opening, having a hexagonal (or other shaped) cross-section, in its upper web. Sliding inside this opening is the cylindrical pop-up shaft which has a mating, outer, hexagonal (or other matching shaped) cross-section. The O-ring is slipped over the lower end of the shaft and a cylindrical (or other shaped) weight is screwed onto the lower end of the shaft. Both the O-ring and the weight are of larger diameters than the shaft so as to preclude leakage. The upper end of the shaft terminates in a cylindrical pop-up head which is also larger in diameter than the shaft. The upper end of the head is threaded to receive the spray insert, which must be identical to a standard spray insert. In typical fashion the insert has a small, upwards slanting exit hole or slot. This invention is intended to replace the brass spray inserts which are easy to remove in existing older sprinkler heads with the capability to continue usage of the sprinkler head at any grass level required.

The second objective of the present invention is to eliminate the sprinkler head housing entirely. This is accomplished by utilizing the collar, the pop-up shaft with threaded head, the O-ring, the weight, and the spray insert defined above. In this alternate embodiment, the threads of the collar are standard pipe threads. Thus the collar can be screwed directly onto the in-ground riser. The pop-up is assembled through the hole in the collar and the spray insert screwed into the pop-up head before the collar is screwed onto the in-ground riser. This embodiment eliminates the sprinkler head body. Thus accumulation of debris and sticking pop-ups are eliminated.

An appreciation of the other aims and objectives of the present invention and an understanding of it may be achieved by referring to the accompanying drawings and description of a preferred embodiment.

DETAILED DESCRIPTION OF THE PREFERRED EMBODIMENT

Figure 1:
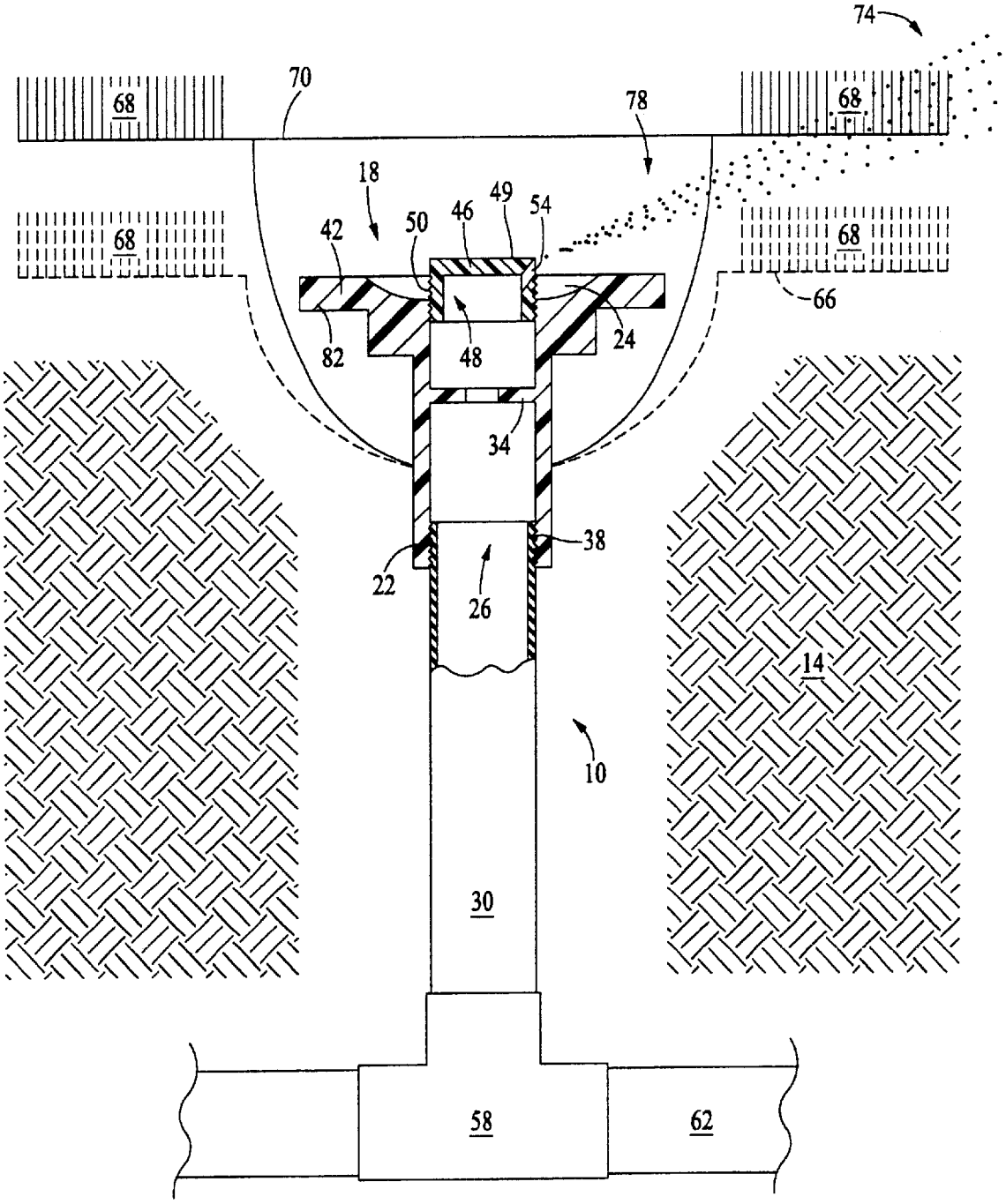
Figure 1 PRIOR ART
FIG. 1 is a partial, partially cut-away, side view of a typical prior art sprinkler system.

FIG. 1 shows a side view of a typical prior art sprinkler system 10 as installed in the ground 14. The existing, older sprinkler head 18 incorporates a hollow, cylindrical, metal body 22 with an internal bowl 24 and threaded at its lower entrance 26 in order to screw onto a threaded riser 30. Midway within the body 22 there is a flow restrictor 34. The threads 38 are customarily pipe threads to provide a leak-proof seal.

Figure 2:
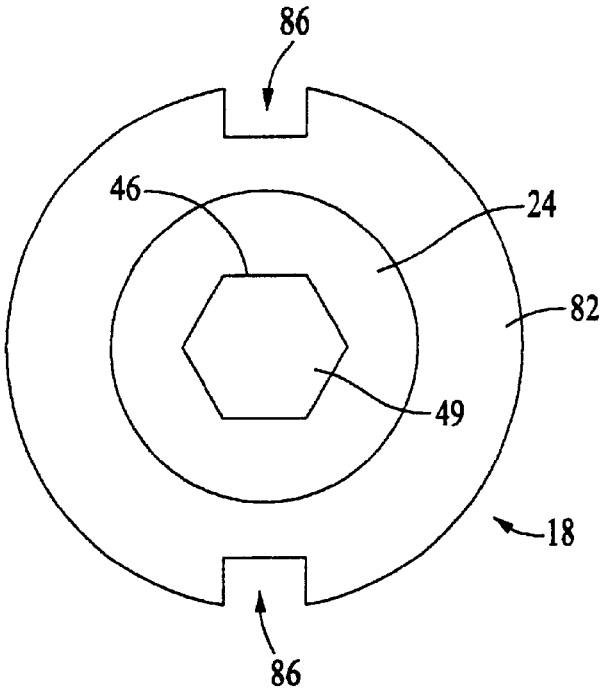
FIG. 2 PRIOR ART
FIG. 2 is a top view of the prior art sprinkler shown in FIG. 1.
Figure 12:
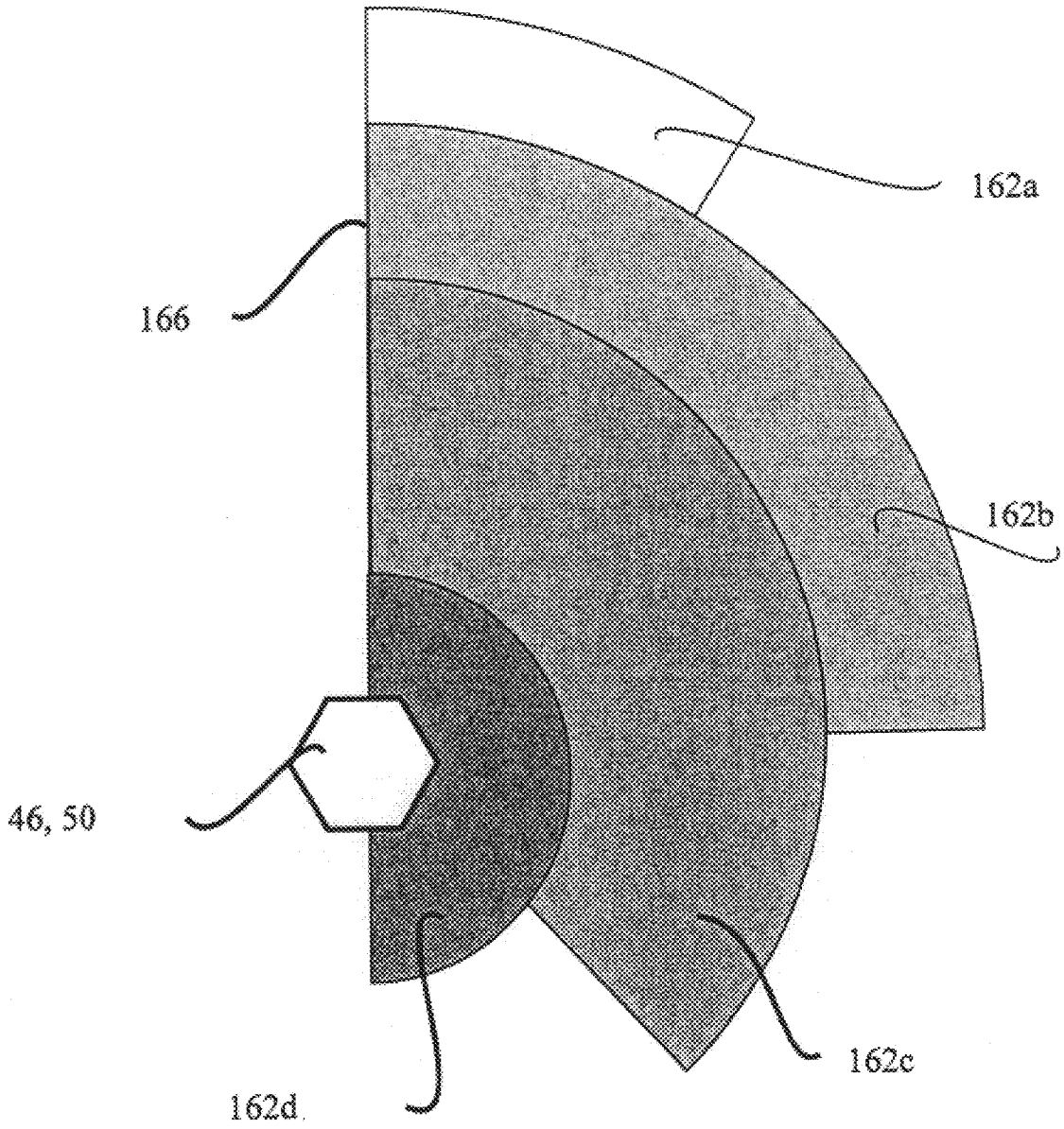
FIG. 12 illustrates some spray patterns that can be achieved with sprinklers in general and with this invention in particular.

At the upper end 42 of the metal body 22, a brass spray insert 46 is screwed into a specially threaded cavity 48. The top 49 of the brass insert 46 is hexagonal as shown in FIG. 2 which allows the insert to be removed with a matching ¾ inch hexagonal brass wrench. The threads 50 on the insert 46 and cavity 48 are specifically not pipe threads in order to prevent improper assembly. The insert 46 has an angled hole or slot 54 through it that is designed to spray water upwards at an angle in an arc or a full circle. Inserts 46 are available which-will spray anywhere from about 30° to 360°. Inserts 46 are also available with threaded restrictor screws so that the diameter of the arc or circle may be adjusted. See the examples in FIG. 12.

Figure 16:
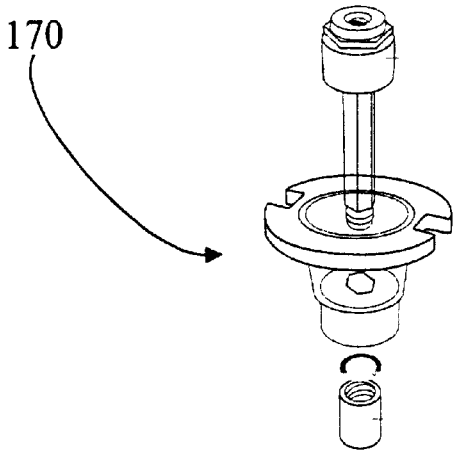
Figure 16 PRIOR ART
FIG. 16 is a three dimensional, exploded view of an old (prior art) pop-up sprinkler.

A riser 30 is screwed into the lower entrance 26 of the brass body 22. The riser 30 connects, some distance below the surface, via a galvanized steel tee or elbow 58 to the galvanized steel piping system 62. Also illustrated on FIG. 1 are the original grade 66 of the grass 68 when the sprinkler system 10 was first installed, the grade 70 of the grass 68 some years later and a typical spray pattern 74 achieved from the insert 46. There is typically a depression 78 in the grade 66 around the sprinkler head 18. It will be readily appreciated from this view that, over time, as the grade 66 increases, spray from the sprinkler 18 will not reach the grass 68 it is intended to water. It will be understood by those familiar with the art to which this invention pertains that the sprinkler head incorporated into the system 10 may be of the pop up variety 170 as illustrated in FIG. 16.

FIG. 2 shows a top view of the sprinkler 18 shown on FIG. 1. In the flange 82 of the body 22 are two wrenching notches 86. A special wrench is available from the manufacturer with a saddle at one end and a hexagonal cavity at the other. The saddle is designed to mate with the notches 86 on the flange 82 while the hexagonal cavity is designed to mate with the top 49 of the insert 46. In this way, wrenching torque can be applied to the body 22 and the insert 46 for assembly and disassembly.

Figure 3:
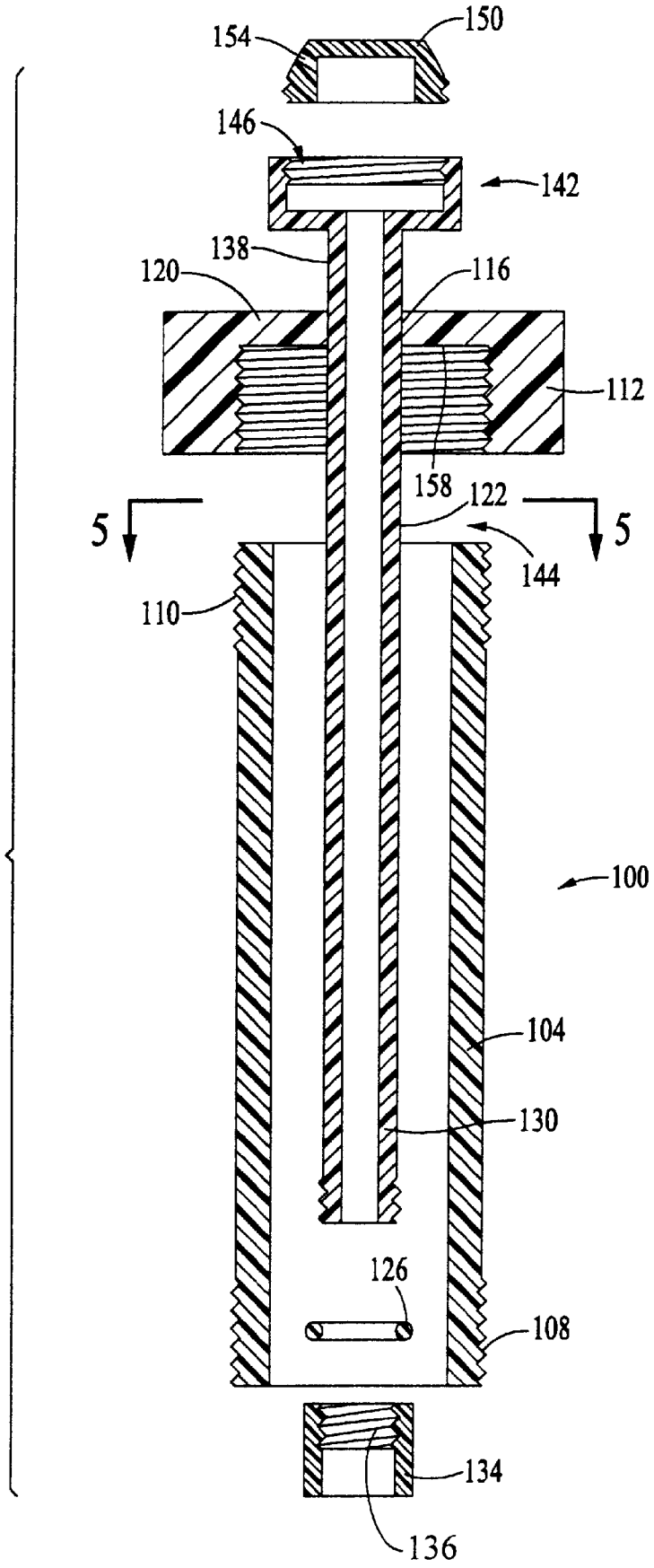
FIG. 3 is an exploded, cross-sectional view of the life extending, pop-up sprinkler insert of this invention.
Figure 8:
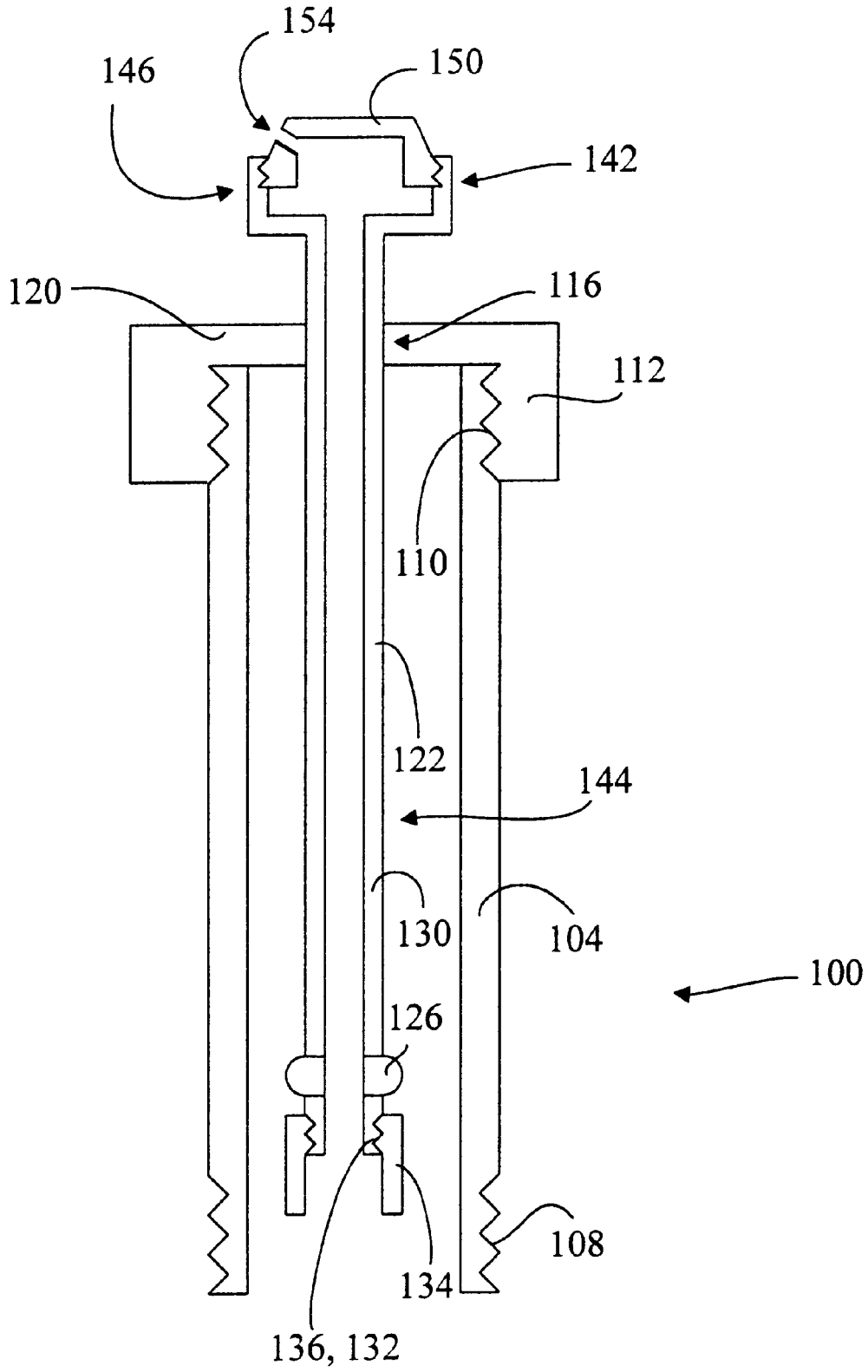
FIG. 8 is a cross-sectional view of the life extending, pop-up sprinkler insert of this invention.

FIG. 3 is an exploded, cross-sectional view of the life extending, pop-up sprinkler insert 100 of this invention. FIG. 8 is a cross-sectional view of the life extending, pop-up sprinkler insert 100 of this invention. This insert 100 has a riser tube 104 which is threaded at both ends. The lower threads 108 are specifically not pipe threads and are designed to mate with the specially threaded cavity 48 in the sprinkler body 22. It will be appreciated that the upper threads 110 can run the full length of the riser tube 104 up to the lower threads 108. The riser tube 104 can then be cut to a desired length. See FIGS. 10 and 12. The riser tube 104, can also be provided with circumferential wrenching flats (see FIG. 11) in order to facilitate assembly.

Threaded onto the upper threads 110 is collar 112, which has a opening 116 having, preferably, a hexagonal cross-section, in its upper web 120. Sliding inside this opening 116 is a cylindrical pop-up shaft 122 with mating, outer cross-section. Tolerances of the opening 116 and shaft 122 are maintained tight so that there is little play. As a consequence, when the pop-up shaft 122 rises to its full extension, it stays in-line with the riser tube 104 and does not flop. An O-ring 126 is slipped over the lower end 130 of the shaft 122. Screwed onto the lower end 130 of the shaft 122 is a cylindrical weight 134. The lower end 130 of the shaft 122 and the interior of the cylindrical weight 134 carry mating threads 132, 136. Both the O-ring 126 and the weight 134 are of larger diameter than the shaft 122. The upper end 138 of the shaft 122 terminates a cylindrical pop-up head 142 which is also larger in diameter than the shaft 122. The head 142 may be a separate part or integral with the pop-up shaft 122 and does not need to be of hexagonal cross section. The subassembly of the shaft 122, head 142, O-ring 126 and weight 134 is known as the pop-up 144. The upper end 146 of the head 142 is internally threaded to receive a spray insert 150, which is preferably identical to a standard spray insert 46. The threads here are specifically not pipe threads. In typical fashion the insert 150 has a small, upwards slanting exit hole or slot 154. Those most familiar with the art to which this invention pertains will know that inserts 150 used with this invention can be designed to spray anywhere from a very narrow arc to a full circle and to include restrictor screws so that the radius of the arc or circle may be adjusted. See FIG. 12.

Figure 4:
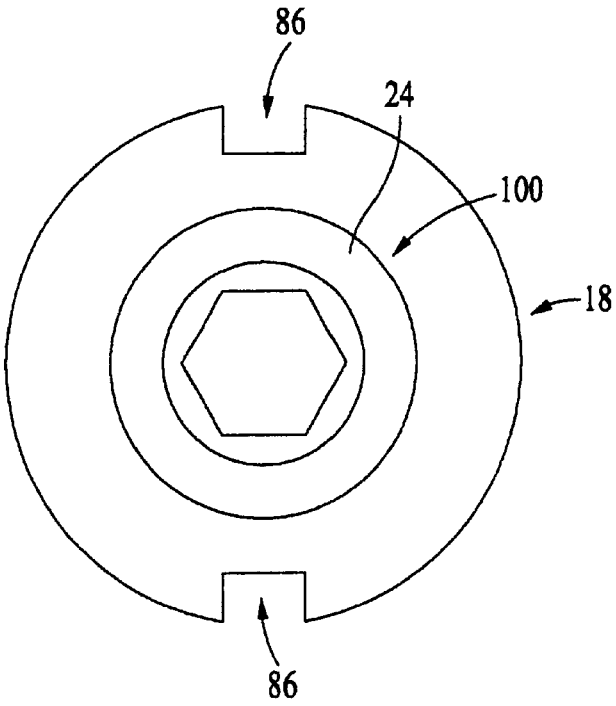
FIG. 4 is a top view of the life extending, pop-up sprinkler shown in FIG. 3 installed in a prior art sprinkler head.
Figure 5:
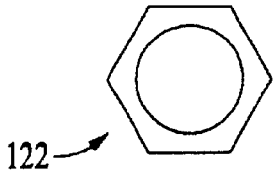
FIG. 5 is a cross section of the pop-up shaft as indicated on FIG. 3.

FIG. 4 is a top view of the life extending, pop-up sprinkler 100 shown in FIG. 3 installed in a sprinkler head 18. FIG. 5 is a cross section of the pop-up shaft 122 as indicated on FIG. 3.

Figure 6:
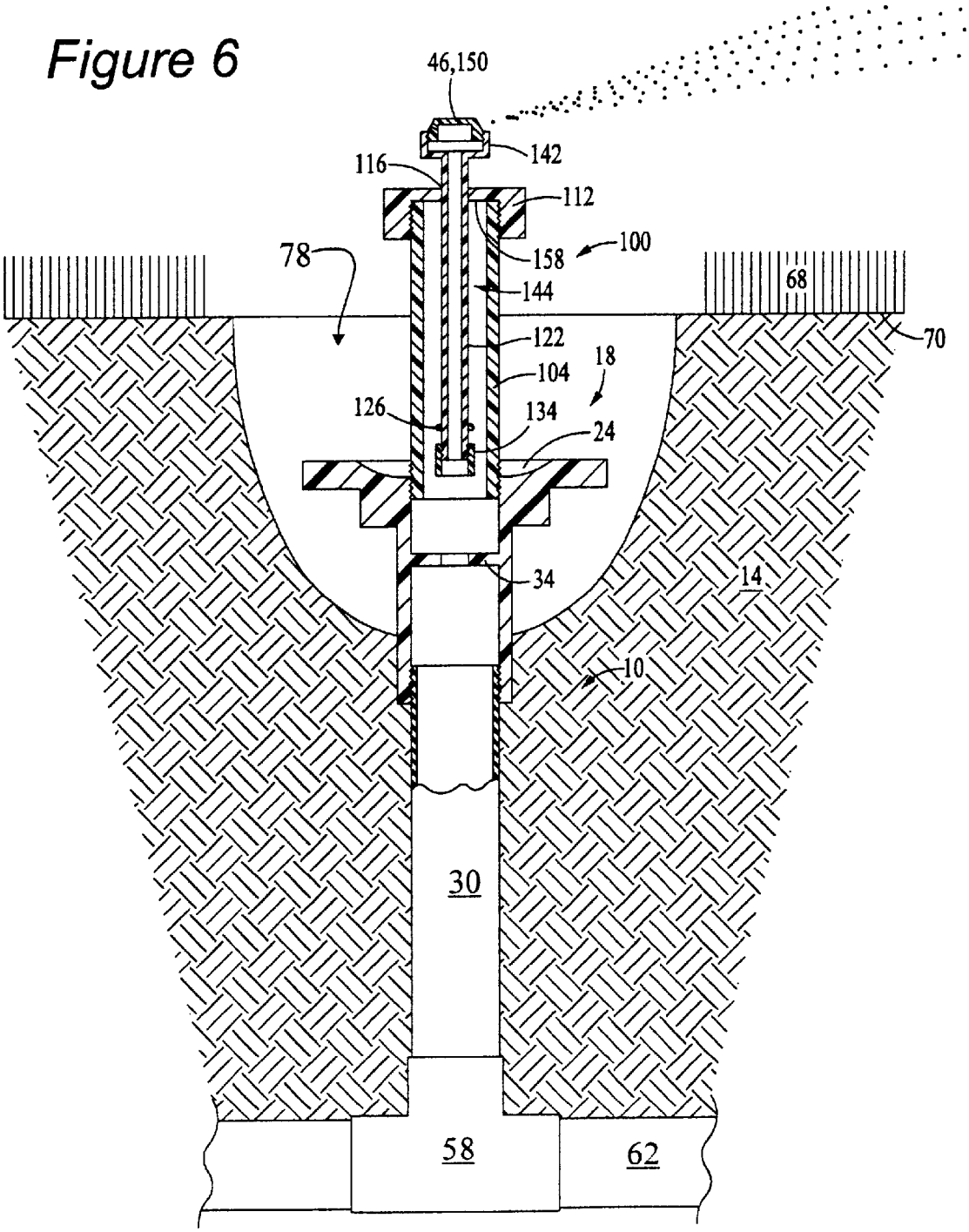
FIG. 6 is a partial, cut-away, side view of the life extending, pop-up sprinkler insert of this invention installed in a prior art sprinkler body, which is part of an installed sprinkler system.
Figure 17:
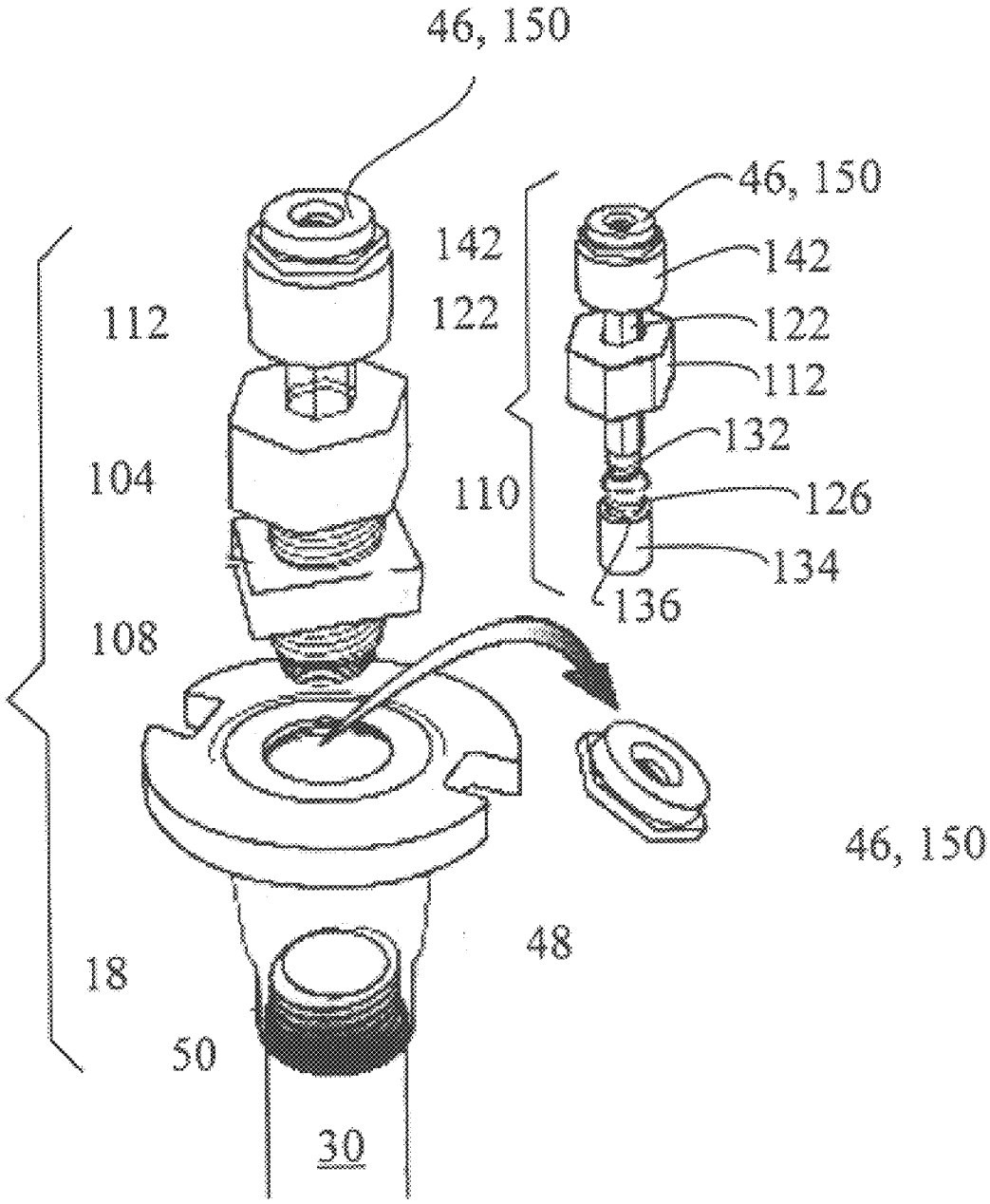
FIG. 17 is a three dimensional, exploded view of this invention.

FIG. 6 is a side, partial view of the life extending pop-up sprinkler insert 100 of this invention installed in a prior art sprinkler body 18, which is part of an installed sprinkler system 10. In other words, the normal spray insert 46 has been removed and replaced with this invention 100. After assembly, as indicated by the bracket on FIG. 3, depending on the length of the riser tube, when no water is flowing, the weight 134 rests above or directly on top of the flow restrictor 34. All or a portion of the shaft 122 is then inside the riser tube 104. When water is flowing, water pressure against the insert 46 or 150 overcomes the force of the weight 134 and lifts the head 142 until the O-ring 126 seats against the underside 158 of the collar 112. The maximum length of the shaft 122 is then above the collar and the O-ring 126 seals the assembly 100 against water leakage at the opening 116. Since the shaft 122 terminates in a head 142 and weight 134 of larger diameter than the opening 116, it is trapped inside the opening 116 and can only slide up and down under the influence of the weight 134 and water pressure. It will be obvious to those most familiar with the art to which this invention pertains that the lengths of the riser 104 and shaft 122 can be adjusted at will to accommodate a variety of grade 66 increases and to provide a variety of pop-up 144 heights. See FIGS. 13, 14 and 15. In other words, this invention can be sold in a variety of sizes or cut to desired size. It is also clear that the preferred materials of construction are brass for the weight 134, rubber for the O-ring 126 and plastic for all the other parts. FIG. 17 better illustrates this invention and how it is assembled.

The various components of this invention 100 can be purveyed in kit form. Since existing pop-ups 144 and spray inserts 46 can be re-used and are available very cheaply, kits may contain just the collar 112 and the riser tube 104. Alternatively, kits may also include a pop-up subassembly 144 and a new spray insert 150.

In FIG. 6, the water has been turned on, the pop-up 144 is rising and water is being sprinkled onto the grass 68 instead of against the side of the depression 78 in which the sprinkler 18 sits. As a consequence of the tight tolerances, as the pop-up shaft 122 rises to its full extension, it stays in-line with the riser tube 104 and does not flop. Therefore, the pop-up will not jam in the up position. This Figure amply illustrates how use of this invention 100 can overcome the effects of grade increases. Replacing sprinkler inserts 46 in a sprinkler system 10 is far less labor intensive and expensive than replacing a whole sprinkler system 10. This invention 100 extends the life of sprinkler systems 10 because it eliminates the necessity of replacing the entire system because the grade 66 has increased and the components 62, 58, 30, 18 are corroded together.

Figure 7:
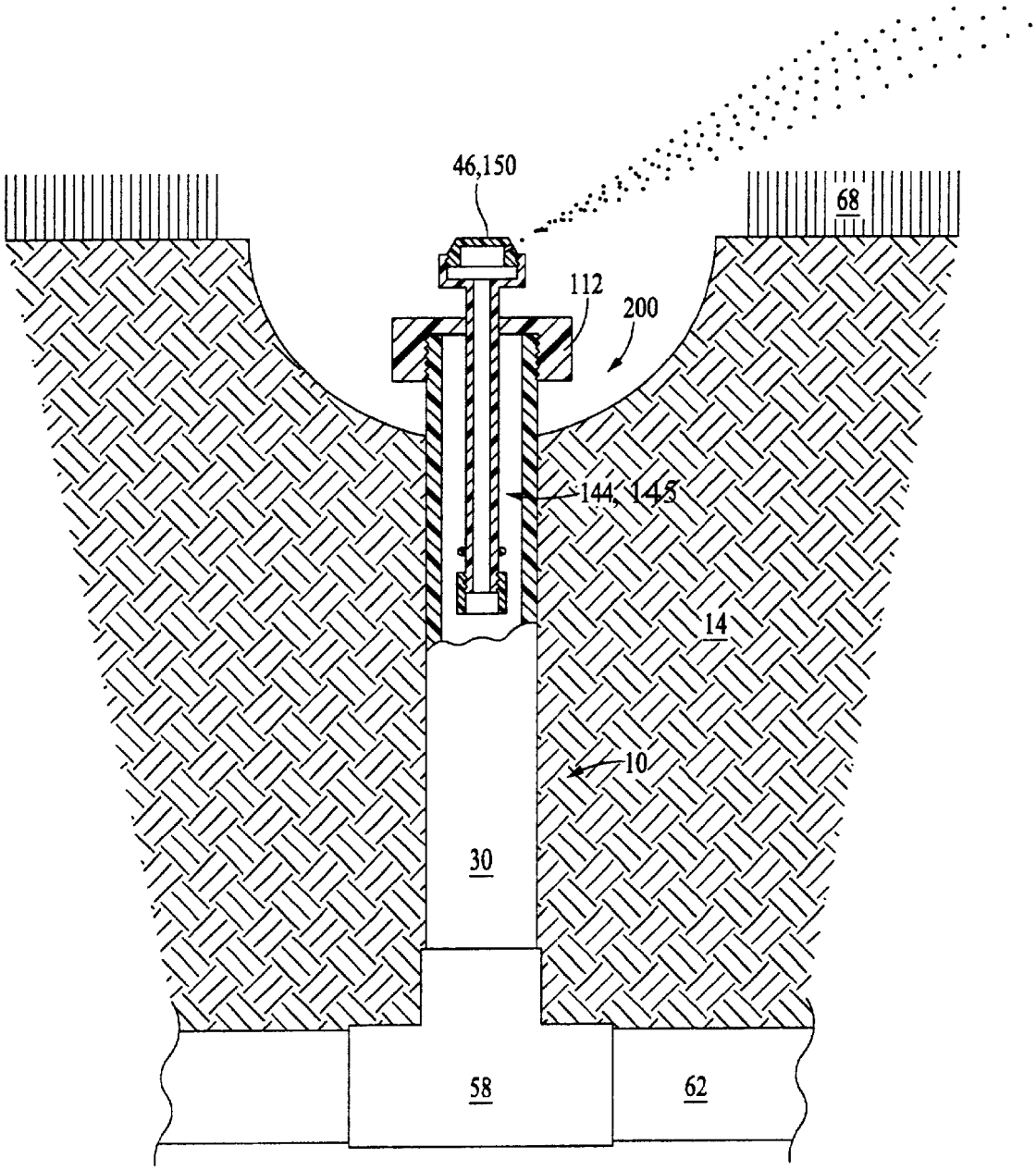
FIG. 7 is a partial, cut-away, side view of an alternate embodiment of the life extending, pop-up sprinkler insert of this invention installed directly on a sprinkler riser, which is part of an installed sprinkler system.
Figure 18:
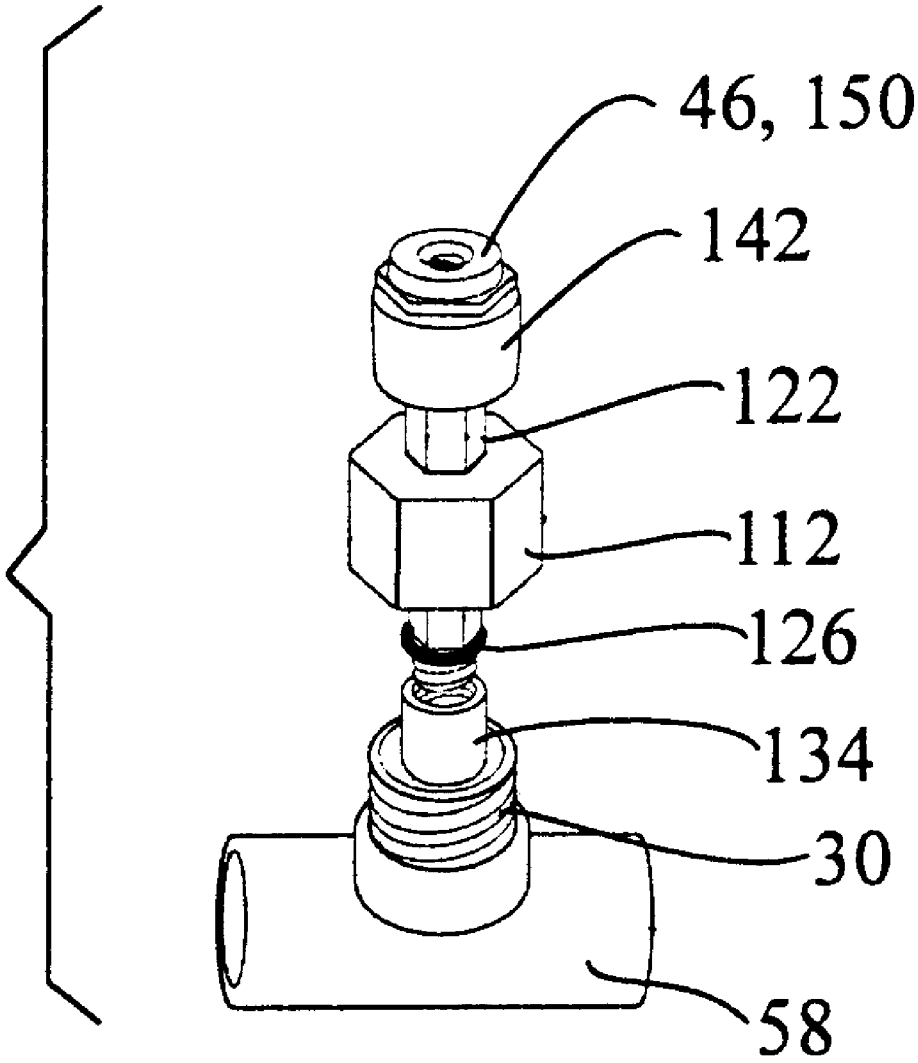
FIG. 18 is a three dimensional, exploded view of the alternate embodiment of this invention.

FIG. 7 is a partial, cut-away, side view of an alternate embodiment 200 installed directly on a sprinkler riser 30, which is part of an installed sprinkler system 10. FIG. 18 is a three dimensional, exploded view of the alternate embodiment 200 of this invention. This embodiment 200 comprises only the collar 112, the pop-up subassembly 144 and the spray insert 46 or 150. The collar 112, of course, must be threaded with pipe threads in order to mate with the in-ground riser 30. The sprinkler head body 22 is eliminated. The old pop-up subassembly 145 and spray insert 46 may be re-used. Thus kits will contain the collar 112 and may also contain a new pop-up subassembly 144 and spray insert 150. Assembly will be obvious from FIG. 7 and the descriptions provided above. As a consequence of the tight tolerances as the pop-up shaft 122 rises to its full extension, it stays in-line with the riser tube 104 and does not flop. Therefore, the pop-up subassembly 144 or 145 will not jam in the up position. As a result this embodiment 200 will not cause persons to trip or allow pop-ups 144 to be cut off by a lawn mower.

Figure 9:
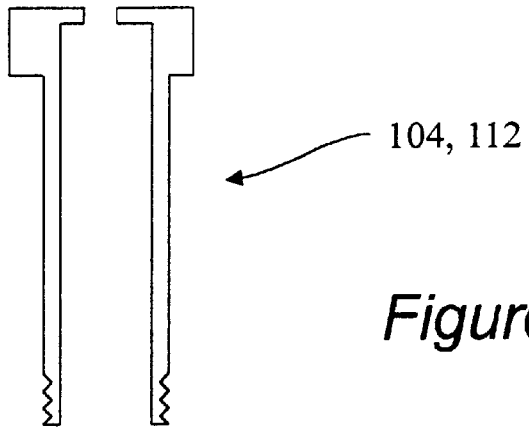
FIG. 9 is a cross sectional figure illustrating an integral collar and riser tube.
Figure 10:
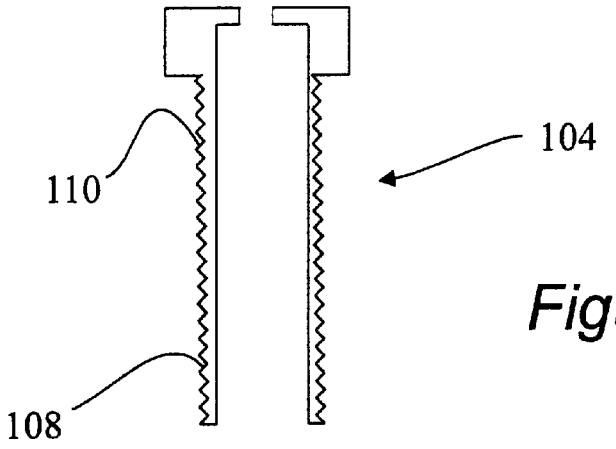
FIG. 10 is a cross sectional figure illustrating a fully threaded riser tube.
Figure 11:
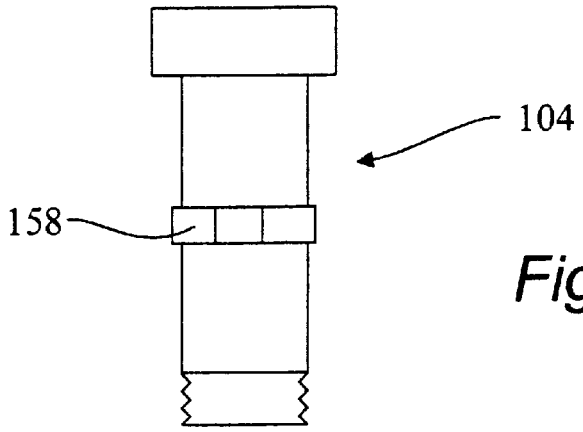
FIG. 11 illustrates a riser tube with wrenching flats.
Figure 13:
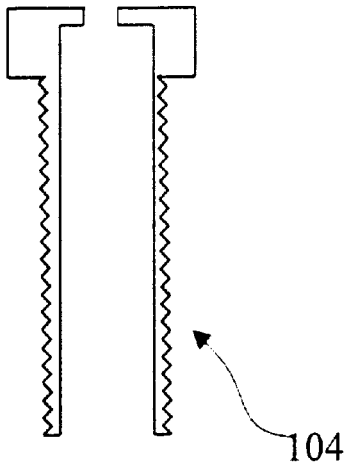
FIG. 13 illustrates a riser tube of a first length.
Figure 14:
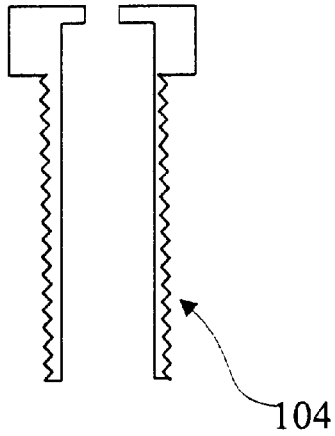
FIG. 14 illustrates a riser tube of a second length shorter than the length illustrated in FIG. 13.
Figure 15:
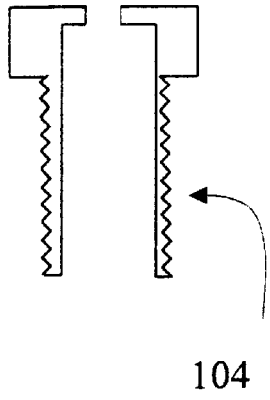
FIG. 15 illustrates a riser tube of a third length shorter than the length illustrated in FIG. 14.

There are a number of variations that can be made to this invention, which have been mentioned previously. FIG. 9 illustrates that the collar 112 and riser tube 104 can alternatively be fabricated as one integral unit; FIG. 10 illustrates a fully threaded riser tube 104; FIG. 11 illustrates a riser tube 104 with wrenching flats 158; and FIGS. 13, 14 and 15 illustrate how the riser tube 104 can be cut to different lengths.

The Dyck invention does not anticipate the instant invention 100, 200. The instant invention 100, 200 does not include the in-ground riser 30 and includes no flares, no hose clamps and does not rely on compression attachments. Whereas, the Dyck invention includes the in-ground riser and includes hose clamps and compression fittings.

The Brady invention also does not anticipate the instant invention 100, 200. The Brady invention is a complete sprinkler head, intended to be installed on an externally, pipe threaded, in-ground riser. The first embodiment 100 of this invention is an adapter intended to be inserted via internal, non-pipe threaded threads 108 into the spray insert cavity 48 of an already installed, prior art, sprinkler head 18. The alternate embodiment includes a cap 112, not a riser. The cap 112 is much smaller that Brady's riser. In Brady's invention the pop-up rises and falls inside the riser whereas in the instant invention 200, the pop-up 144 or 145 rises and falls inside the in-ground riser 30.

The following reference numerals are used on FIGS. 1 through 18:

| | |
|---|---|
| 10 | Prior art sprinkler system |
| 14 | Ground |
| 18 | Prior art sprinkler head |
| 22 | Cylindrical body of prior art sprinkler head |

-continued

| | |
|---|---|
| 24 | Bowl |
| 26 | Lower entrance of prior art brass body |
| 30 | Threaded riser |
| 34 | Flow restrictor |
| 38 | Pipe threads |
| 42 | Upper end of prior art brass body |
| 46 | Spray insert |
| 48 | Cavity for accepting spray insert |
| 49 | Top of spray insert |
| 50 | Threads |
| 54 | Angled hole or slot |
| 58 | Elbow |
| 62 | Piping system |
| 66 | Original grade of grass |
| 68 | Grass |
| 70 | Later grade of grass |
| 74 | Spray pattern |
| 78 | Depression in grade |
| 82 | Flange |
| 86 | Wrenching notch |
| 100 | Life extending, pop-up sprinkler insert |
| 104 | Riser tube |
| 108 | Lower threads |
| 110 | Upper threads |
| 112 | Collar |
| 116 | Hexagonal cross-section opening |
| 120 | Upper web of collar |
| 122 | Pop-up shaft with hexagonal outer, cross-section |
| 126 | O-ring |
| 130 | Lower end of pop-up shaft |
| 132 | Threads |
| 134 | Cylindrical weight |
| 136 | Threads |
| 138 | Upper end of pop-up shaft |
| 142 | Pop-up head |
| 144 | New pop-up subassembly |
| 145 | Old pop-up subassembly |
| 146 | Upper end of pop-up head |
| 150 | Spray insert |
| 154 | Upwards slanting hole or slot |
| 158 | Wrenching flats |
| 162a, b, c, d | Illustrative spray patter arcs |
| 166 | Spray pattern radius |
| 170 | Old (prior art) pop up sprinkler |
| 200 | Alternate embodiment |

The life extending, pop-up sprinkler has been described with reference to particular embodiments 100, 200. Other modifications and enhancements can be made without departing from the spirit and scope of the claims that follow.

What is claimed is:

1. An adapter for extending the life of a sprinkler system, which was installed to spray at an original grade, including a standard sprinkler head body having a spray insert cavity with an original spray insert screwed into said spray insert cavity with threads that will not mate with standard pipe threads, said adapter comprising:

a. a riser tube, having an upper end and a lower end, said lower end carrying threads which will mate with the spray insert cavity in said standard sprinkler head body; and b. a collar, adapted to mate with said upper end, mated with said upper end; said collar having a web portion, said web portion having a opening through it designed to accept a pop-up subassembly without rotation and with little play and allow said pop-up subassembly to rise and fall a short distance;

whereby said riser tube can be installed in said spray insert cavity in place of said original spray insert and said pop-up subassembly can be installed through said web portion so that said sprinkler system will sprinkle an increased grade.

2. An adapter as claimed in claim 1 in which said collar and said riser tube are integral.

3. An adapter as claimed in claim 1 in which said riser tube is fully threaded.

4. An adapter as claimed in claim 1 in which said riser tube includes external wrenching flats.

5. An adapter as claimed in claim 1 further comprising a pop-up subassembly, inserted through said opening; said pop-up assembly having a head designed to receive said original spray insert; said original spray insert being screwed into said head.

6. An adapter as claimed in claim 5 further comprising a new spray insert designed to spray water in a quadrant, inserted in said head.

7. An adapter as claimed in claim 6 in which the radius of said arc is adjustable.

8. An adapter for replacing an old pop-up sprinkler head which is threaded onto a pipe threaded, in-ground riser, said sprinkler head including a pop-up subassembly, said adapter comprising: a collar, adapted to screw onto said pipe threaded, in-ground riser; said collar having a web portion; said web portion having an opening through it designed to accept said pop-up subassembly without rotation and with little play and to allow said pop-up subassembly to rise and fall a short distance; said pop-up subassembly assembled through said opening; said collar screwed onto said pipe threaded, in-ground riser; said collar designed so that said pop-up subassembly rises and falls inside said pipe threaded, in-ground riser.

* * * * *